United States Patent [19]

Steinborn et al.

[11] 4,103,498

[45] Aug. 1, 1978

[54] PLUGS FOR BORES IN ROCKS OR THE LIKE

[75] Inventors: Wilhelm Steinborn, Remscheid; Alois Mechenbier, Illingen, Germany

[73] Assignees: Diehl, Nuremberg; Tip-Top-Saar Gesellschaft für industrielle Vulkanisierung m.b.H., Sulzbach-Altenwal d, both of Germany

[21] Appl. No.: 816,861

[22] Filed: Jul. 18, 1977

[30] Foreign Application Priority Data

Jul. 24, 1976 [DE] Fed. Rep. of Germany ..... 2633434

[51] Int. Cl.[2] ..... E21D 21/00

[52] U.S. Cl. ..... 61/45 B; 52/744; 61/63; 264/36; 425/564

[58] Field of Search ..... 61/45 B, 63; 264/35, 264/36; 425/461, 467, 376 R, 376 A, 564, 566; 239/571; 52/741

[56] References Cited

U.S. PATENT DOCUMENTS

| | | | |
|---|---|---|---|
| 1,883,196 | 10/1932 | Wertz | 264/36 |
| 2,739,352 | 3/1956 | Watson | 264/36 |
| 3,211,813 | 10/1965 | Behrendt | 264/36 |
| 3,438,393 | 4/1969 | Godley | 425/564 X |
| 3,492,827 | 2/1970 | Stevens | 61/63 |
| 3,782,640 | 1/1974 | Kirschmann | 239/571 |
| 4,012,822 | 3/1977 | Vrolyk et al. | 264/36 X |

*Primary Examiner*—Dennis L. Taylor
*Attorney, Agent, or Firm*—Walter Becker

[57] ABSTRACT

A plug or stopper for bores in rocks or the like, which bores, after the drilling, are filled with a self-hardening synthetic material, such as commercially available epoxy resin mixtures, polyester resin mixtures, and cyanoacrylate adhesives. The plug is pressed or driven into the bore and consists essentially of an elastically deformable material, especially rubber or rubber-like synthetic resin. The outer diameter of the plug corresponds to the diameter of the rock bore. The plug tapers mainly toward the front and is provided on its outer circumference with grabbing elements. The inside of the plug is provided with an axial bore which becomes narrower toward the back. A closure member which serves as a valve body is axially displaceably arranged in the plug in such a way that it seals off the axial bore when pressure is directed toward the back.

20 Claims, 4 Drawing Figures

PLUGS FOR BORES IN ROCKS OR THE LIKE

The present invention relates to plugs or stoppers for bores in rocks and the like, which bores, after the drilling, are filled with a self-hardening synthetic material, such as commercially available epoxy resin mixtures, polyester resin mixtures, and cyanoacrylate adhesives.

It is an object of the present invention to produce a self-sealing plug for bores in rocks, coal, and the like, which plug makes it possible to press a fluid or pasty medium, for example a self-hardening synthetic material, into the bore and to seal off the bore in a valve-like manner.

This object and other objects and advantages of the present invention will appear more clearly from the following specification in connection with the accompanying drawings, in which.

The plug pursuant to the present invention is characterized primarily in that the plug, which is pressed or driven into the bore, consists essentially of an elastically deformable material, especially rubber or rubber-like synthetic resin. The outer diameter of the plug corresponds to the diameter of the rock bore. The plug tapers mainly toward the front and is provided on its outer circumference with grabbing elements. The inside of the plug is provided with an axial bore which becomes narrower toward the back. A closure member which serves as a valve body is axially displaceably arranged in the plug in such a way that it seals off the axial bore when pressure is directed toward the back.

Pursuant to a further feature of the present invention, the axial bore is provided with an abutment or gradation which serves as a valve seat and is designed as a tapered shoulder. The closure member may be a sphere of steel, glass, rubber, synthetic resin, or the like or it may also be peg-like and be provided on the side of the tapered shoulder with a cone or tapered point.

The plug or the axial bore thereof may be lined with a pressed-, glued-, vulcanized-, or injected-in conduit, particularly a metal pipe which extends toward the back at least up to the tapered shoulder and in which the closure member is axially displaceable with radial clearance. In the forward portion, the axial bore or the conduit is in most instances provided with a barrier which limits the displacement path or the stroke of the closure member toward the front and is designed, for example, as a steel pin or the like which passes transversely through the axial bore. The pin is in most instances first inserted or driven transversely into the plug after introduction of the closure member.

A plug characterized as above is pressed or driven into the bore after the latter is made in the rock or coal. A fluid, pasty, or pulpy medium, for example a self-hardening synthetic resin, may be injected into the bore through the axial channel by means of a conduit which is inserted into the axial channel from the back. In this connection, the synthetic resin flows past the closure member. After the conduit is pulled out, the closure member is pushed back onto the tapered shoulder by the counterpressure of the injected medium, sealing the bore.

Figure 1:
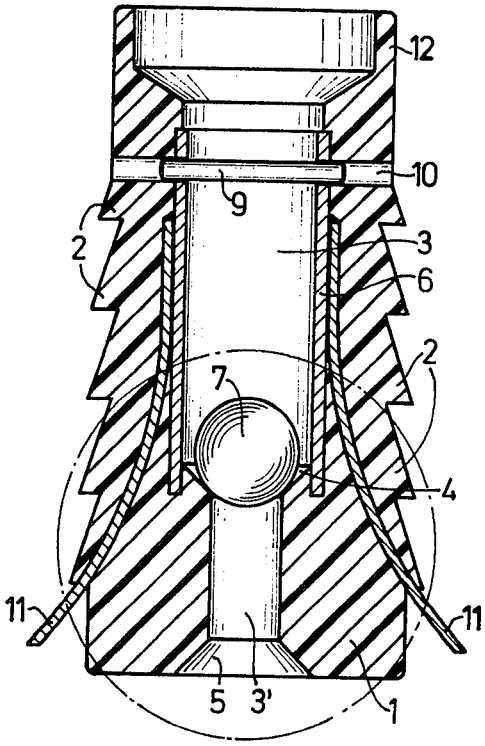
FIG. 1 is a longitudinal section of a plug according to the present invention.
Figure 3:
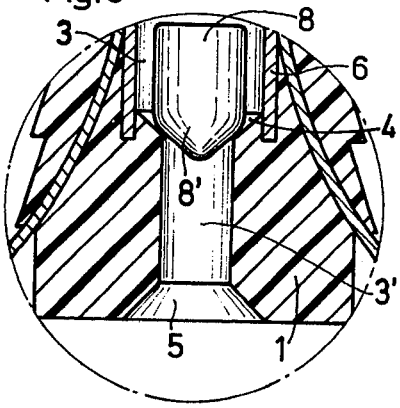
FIG. 3 is a variation of the dot-dash encircled portion of FIG. 1.
Figure 2:
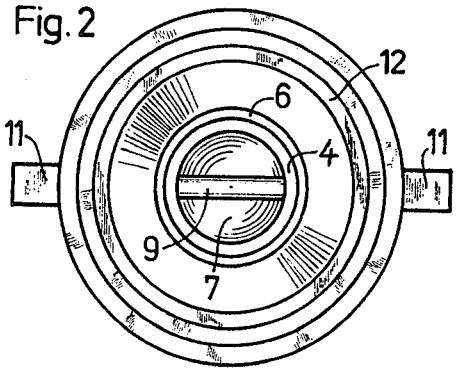
FIG. 2 is a top view of the plug of FIG. 1.

Referring now to the drawing in detail, in FIGS. 1 and 2, the plug 1, which consists primarily of a tough elastic deformable material, for example rubber or rubber-like synthetic resin, and which tapers toward the front or top, is provided on its outside with ribbed or fluted grabbing elements 2 which in longitudinal section are saw-tooth like. An axial bore 3, which is narrower in the back or bottom portion 3', extends through the plug 1. Between the sections 3 and 3' of the axial bore, there is an abutment or gradation in the form of a tapered shoulder 4. On its back or bottom end, the axial bore 3' has a funnel-shaped or (FIG. 3) trumpet-shaped widened section 5 which simplifies the insertion of a conduit 13 (FIG. 4), as further explained below. The wider portion 3 of the axial bore is lined with a pipe 6 which extends up to the tapered shoulder 4 and is firmly connected with the plug 1, for example, by being pressed, glued, vulcanized, or injected therein. A closure member 7 with radial clearance is axially displaceably arranged in this cylindrical pipe 6. The closure member 7 comprises, for example according to FIGS. 1 and 2, a sphere which is made of hard rubber, glass, ceramic, steel, or synthetic resin. As shown in FIG. 3, such a closure member 7 may also be a peg 8 and be provided on the side of the tapered shoulder 4 with a cone or tapered point 8'.

The closure member 7,8 is in most instances introduced from the front or top into the plug 1 prior to additionally introducing a barrier 9 which passes transversely through the axial bore 3. This barrier 9 comprises at least one steel pin which may be pressed or driven into a bore 10 of the plug 1 and which defines or limits the axial stroke of the closure member 7,8.

Two or more resilient metal strips 11 are additionally attached to the pipe 6. The resilient strips 11 are bent outwardly in the shape of trumpets toward the back or bottom and at the same time may serve as clamping or grabbing elements within the bore 14 of the rock (FIG. 4).

Figure 4:
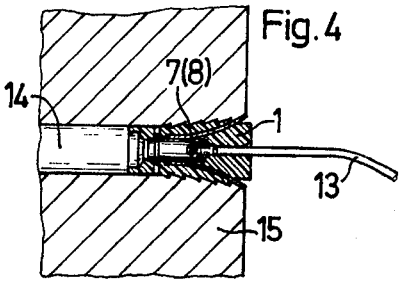
FIG. 4 is a transverse section of an example of application of the plug FIGS. 1 and 2.

Toward the front or top, the wall thickness of the plug 1 eventually narrows in such a way that the upper, cylindrical rim forms a sealing lip 12 which, as shown in FIG. 4, under radial pressure upon the sealing lip 12 from within, engages the wall of the rock bore 14 under elastic stress and in addition aids in plugging up or sealing the bore 14 under pressure.

FIG. 4 shows a rock wall 15 with the bore 14 into which is driven the plug 1 of FIGS. 1 and 2. The conduit 13 is inserted into the axial bore of the plug 1 from the back. The above mentioned medium is pressed into the bore 14 through the conduit 13, past the closure member 7, in a manner not shown. In so doing, the sphere 7 or the peg 8 (FIG. 3) is first pressed forward, in which connection the stroke is defined or limited by the barrier 9. The filling medium enters the bore 14 through the closure member 7 or 8 and the pipe 6, which protects the plug 1, and especially the axial bore 3 thereof, against deformation. At the same time, the filling medium presses the sealing lip 12 radially against the wall of the bore 14.

After the bore 14 is filled, the conduit 13 is pulled out of the plug 1. The counterpressure of the injected medium, for example a self-hardening synthetic material of a polyurethane base, of epoxy resin mixtures, or of cyanoacrylate adhesives, pushes the closure member 7,8 in the pipe 6 back until it sealingly engages the tapered shoulder 4 and seals the axial bore 3.

It is, of course, to be understood that the present invention is by no means limited to the specific showing of the drawing, but also encompasses any modifications within the scope of the appended claims.

What we claim is:

1. A plug adapted to be introduced into a bore in rock or the like, which comprises:

a section of elastically deformable material, said section having a front end, a back end, and a lateral surface area, said front end being adapted to enter the rock bore to be plugged prior to any other portion of said plug, the outer diameter of said section roughly corresponding to the diameter of said rock bore to be plugged, the outer peripheral surface area of said plug tapering slightly mainly toward said front end;

grabbing elements provided on at least a portion of said peripheral surface area, said grabbing elements being adapted to frictionally engage the inner surface of the rock bore to be plugged for securely holding said plug therein, the inside of said plug being provided with an axial bore which narrows toward said back end, said axial bore being adapted to receive a self-hardening material; and a closure member displaceably arranged in said axial bore for sealing off same at its narrower end when pressure is directed against said closure member from the said front end in the direction toward said rear end.

2. A plug according to claim 1, in which said axial bore is provided with a gradation in the form of a tapered shoulder which serves as a seat for said closure member.

3. A plug according to claim 1, in which said closure member is peg-shaped having one end thereof tapered.

4. A plug according to claim 1, in which at least a portion of said axial bore is lined with pipe means which extend toward said back end at least to the area where said axial bore narrows, said pipe means having a diameter greater than said closure member.

5. A plug according to claim 4, in which said pipe means is a metal pipe.

6. A plug according to claim 1, in which barrier means are arranged in said plug in such a way as to traverse said axial bore near said front end for limiting the stroke of said closure member in said axial bore.

7. A plug according to claim 6, in which said barrier means is a steel pin.

8. A plug according to claim 1, in which said grabbing elements are annular ribs of saw-tooth cross section.

9. A plug according to claim 4, which includes trumpet-shaped outwardly extending metal strip means having that end portion thereof which is remote from said trumpet-shaped outwardly extending end portion connected to said pipe means, said trumpet-shaped outwardly extending end portion extending outwardly beyond the outer diameter of said grabbing elements.

10. A plug according to claim 1, in which said front end of said plug has a sealing lip reduced in thickness over the thickness of the remaining plug wall and operable to bend radially outwardly in response to radially outwardly directed pressure acting upon said lip.

11. A plug according to claim 1, in which said axial bore within the region of said back end is provided with a funnel-shaped recess for receiving conduit means.

12. A plug according to claim 1, in which said self-hardening material consists of an epoxy resin mixture.

13. A plug according to claim 1, in which said self-hardening material consists of a polyester resin mixture.

14. A plug according to claim 1, in which said self-hardening material consists of a cyanoacrylate adhesive.

15. A plug according to claim 1, in which said elastically deformable material consists of rubber.

16. A plug according to claim 1, in which said elastically deformable material consists of a rubber-like synthetic resin.

17. A plug according to claim 1, in which said closure member is a sphere of steel.

18. A plug according to claim 1, in which said closure member is a sphere of glass.

19. A plug according to claim 1, in which said closure member is a sphere of rubber.

20. A plug according to claim 1, in which said closure member is a sphere of synthetic resin.

* * * * *